US005941767A

United States Patent [19]

Fukuda

[11] Patent Number: 5,941,767

[45] Date of Patent: Aug. 24, 1999

[54] AIR CIRCULATING DEVICE

[76] Inventor: Kozo Fukuda, 1-6-1-920, Kaigan, Minato-Ku, Tokyo, Japan, 105

[21] Appl. No.: 08/952,502

[22] PCT Filed: May 16, 1996

[86] PCT No.: PCT/JP96/01300

§ 371 Date: Nov. 17, 1997

§ 102(e) Date: Nov. 17, 1997

[87] PCT Pub. No.: WO96/36839

PCT Pub. Date: Nov. 21, 1996

[30] Foreign Application Priority Data

May 17, 1995 [JP] Japan ..... 7-004654 U

[51] Int. Cl.[6] ..... F24F 7/007

[52] U.S. Cl. ..... 454/230

[58] Field of Search ..... 454/230, 231, 454/232, 233

[56] References Cited

U.S. PATENT DOCUMENTS 4,945,820 8/1990 Fukuda ..... 98/31.5

FOREIGN PATENT DOCUMENTS 6-36437 9/1994 Japan .
2534603 2/1997 Japan .

*Primary Examiner*—Harold Joyce
*Assistant Examiner*—Derek S. Boles
*Attorney, Agent, or Firm*—Wenderoth, Lind, & Ponack, L.L.P.

[57] ABSTRACT

An air circulating device efficiently circulates air in a room in a building while and having a simple structure.

The air circulating device has at least one duct (10) and at least one fan (40) for circulating air. The duct has at one end a first air port (20) and at the other end a second air port (21). The duct is mounted on a wall surface by mounting device (12).

2 Claims, 8 Drawing Sheets

AIR CIRCULATING DEVICE

TECHNICAL FIELD

The present invention relates to an air circulating device, mainly for reversing the flow of air in a room from the floor to the ceiling of the room and vice versa.

BACKGROUND ART

A conventional room air circulating device is known in Japanese Patent Laid-Open No. 49945/1986. In this device a suction port for room air is provided in a lower end portion of a hollow box, an air outlet is provided in an upper end portion of the box, and a suction/exhaust fan is provided in the box. In addition, as disclosed in Japanese Utility Model Laid-Open No. 176042/1985, there is known an air circulating device in which venting holes are formed in upper and lower portions of a piece of room dividing furniture such as a screen on a partition, in which the upper and lower venting holes communicate with each other via an air flow path, and in which a blower is provided in the air flow path. Furthermore, as disclosed in Japanese Utility Model Laid-Open Nos. 66727/1986, 116934/1986 and 170936/1986, there is known an air circulating device in which suction and exhaust ports are formed in upper and lower portions of a storage cabinet, and in which a fan is provided in an air passageway.

As described above, however, in the prior art air circulating devices, since suction and exhaust ports are formed in upper and lower end portions of a box, a storage cabinet or the like which is designed to be placed on the floor, there is a limitation on the arrangement of the suction and exhaust ports when they are tried to be formed as close to the ceiling and floor as possible, thus leading to a situation in which complete air circulation in a room is not possible. In particular, since the temperatures of air in a room provided with heating and cooling equipment are different to the extent that they are located near the ceiling and the floor, it is desirable that suction and exhaust ports are disposed as close to the ceiling and floor as possible in order to have a uniform room temperature. As clear from the above, with the prior art air circulating devices, in order to have efficient air circulation, air circulating devices in various dimensions have to be produced so as to fit into rooms of different ceiling heights one drawback of which is an increase in the cost of production.

Furthermore, in the prior art air circulating devices as described above, since they take the form of a box or a storage cabinet, the de-vices tend to the made larger, and the air circulation efficiency is inferior.

Accordingly, it is an object of the present invention to provide an air circulating device in which a temperature difference between upper and lower portions in a room is eliminated and a uniform room temperature can usually be maintained.

Also, it is an object of the present invention to provide an air circulating device capable of adapting to the height of the ceiling in a room.

SUMMARY OF THE INVENTION

The present invention provides an air circulating device comprising a duct having an air circulating fan installed therein and adapted to be mounted on a wall and a mounting means for mounting the duct onto the surface of a wall, wherein the duct is designed to be reversed by being rotated or the like relative to the surface of a wall.

It is possible to reverse the flow of air from the floor to the ceiling of a room and vice versa.

Preferred modes of the present invention are as follows.

(1) An air circulating device has a mounting means which comprises a double-sided adhesive coated tape, a mechanical engaging tape (so-called Velcro tape) or the like for removably mounting a duct on a wall surface.

(2) An air circulating device comprises a mounting means for removably mounting a duct having a fan on a wall surface in a substantially vertical condition to dispose a first air port of the duct in an upper position and a second air port of the duct in a lower position.

The duct can be positioned in the reverse position to dispose the first air port in the lower position and the second air port in the upper position when the duct is removed from the wall surface and reattached to the wall surface.

(3) An air circulating device has a duct which includes a fan and is rotatably attached to a wall surface. The duct can be disposed between a first position in which a first air port of the duct is positioned in an upper position and a second air port of the duct is positioned in a lower position and a second position in which the second air port is positioned in the upper position and the first air port is positioned in the lower position.

(4) An air circulating device comprises a duct which is fixed to a wall surface and a fan which can be reversely attached to the duct to cause air sucked from a first air port of the duct to flow to a second air port of the duct or to cause air sucked from the second air port to flow to the first air port.

The air circulating device comprises a fan rotatably mounted on the duct and means for positioning the duct between a first position in which the air flows from the first air port of the duct to the second air port and a second position in which, reversely, the air flows from the second air port to the first air port.

The fan can be attached to the duct to insert into an opening formed in the duct and to draw out from the opening. Also, the fan can be inserted into the opening and drawn out from the opening if the fan is reversed.

(5) An air circulating device has a duct the entire length of which can be adjusted by means of an adjusting means. As an example of such adjusting means, it is considered that the duct comprises a plurality of duct portions which are telescopically connected together to be adjustable over the length of the duct or a portion of the duct is cut to adjust the length of the duct.

BEST MODE FOR CARRYING OUT THE INVENTION

Further detailed description of the present invention references the attached drawings.

Figure 1:
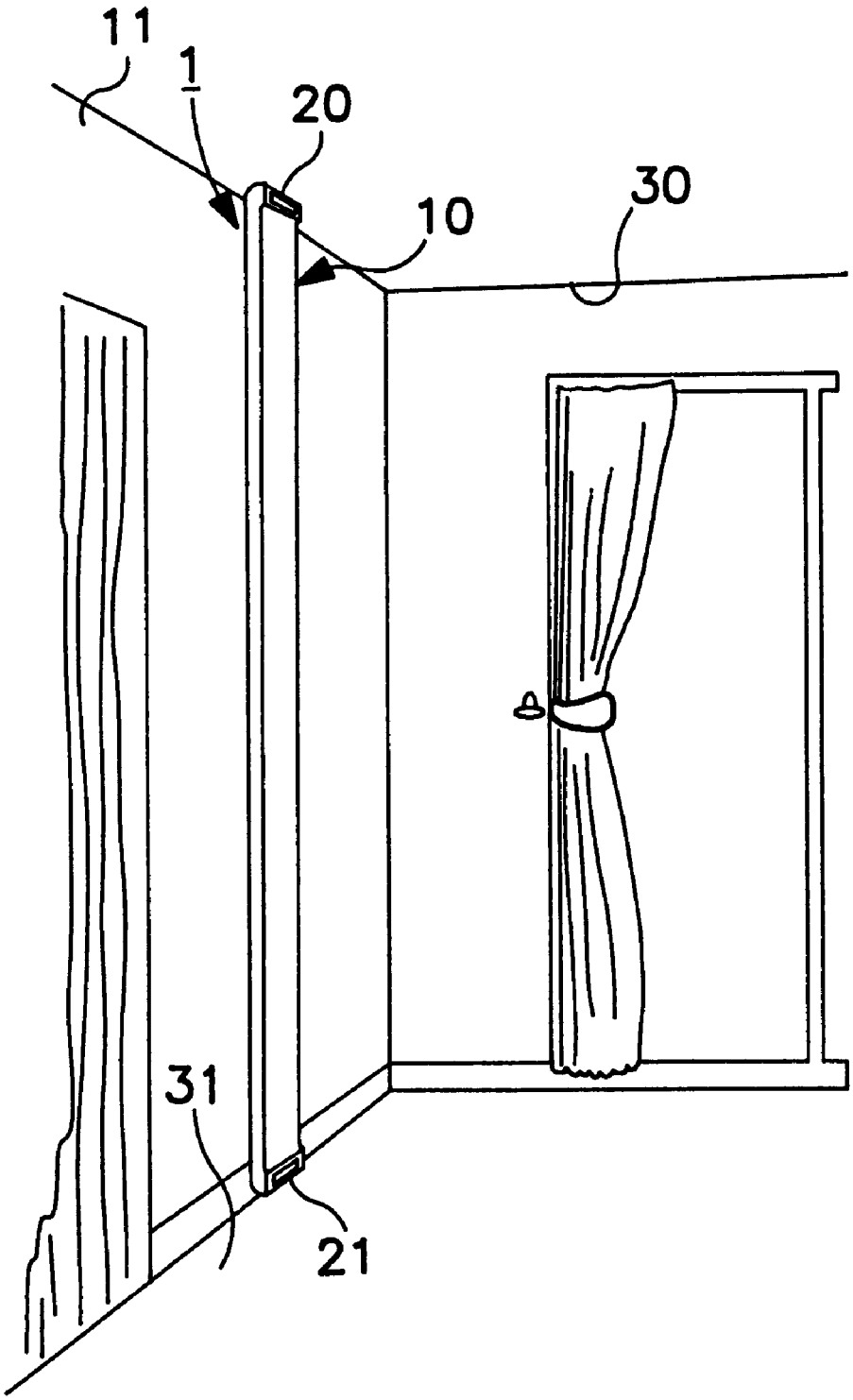
FIG. 1 is a perspective view showing a state in which an air circulating device according to the present invention is mounted on the surface of a wall.

Referring to FIG. 1 first, it shows an example in which an air circulating device according to the present invention is mounted on the surface of a wall in a room of a normal house. This air circulating device is typically provided with one duct 10. In this embodiment, the air circulating device 1 of the present invention is designed to be mounted on the surface of a wall of a room of a building, but the mounting place is not limited to the wall. For instance, the duct 10 can be formed by using structural members of a building so that it can integrally be incorporated into the building.

Figure 2:
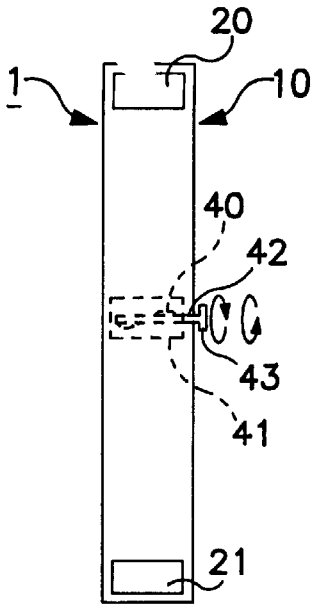
FIG. 2 is a front view schematically showing the air circulating device of a first embodiment of the present invention.
Figure 3:
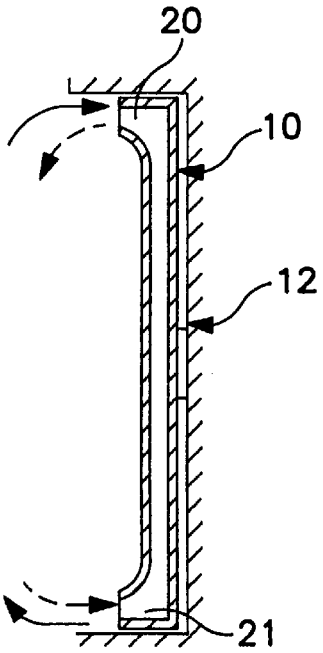
FIG. 3 is a side view of FIG. 2.

In embodiments shown in FIGS. 1 to 3, a single duct 10 is mounted on a wall surface 11 of a room at an optional position via a mounting means 12.

The duct 10 has a first air port 20 at one end, for example, at an upper end, and a second air port 21 at the other end, for example, at a lower end thereof.

In the embodiment shown in FIG. 1, this duct 10 comprises a hollow tube having a rectangular cross-section. The duct could also comprise a hollow tube having a circular cross-section or hollow tubes of other types. There is no limitation on the material of the duct and any material can be used. Typically, it is preferable to use synthetic resin of any type.

In the typical embodiments shown in FIGS. 1 and 2, the duct comprises a single tube, and it is positioned perpendicularly on the wall surface 11 such that the first air port 20 is located near a ceiling 30, while the second air port 21 is located near a floor 31.

The mounting means 12 for mounting the duct 10 onto the wall surface 11 comprises a pressure sensitive adhesive double coated tape. Instead of the pressure sensitive adhesive double coated tape, a so-called Velcro tape may be used as the mounting means. In addition to this, a mounting means of any other type may be used. There is incorporated at least an air circulating fan 40 in the duct 10 substantially at a central portion thereof. This fan is a typical one comprising a motor and vanes.

In the embodiments shown in FIGS. 1 to 3, this fan is mounted on a frame 41, which is in turn mounted on an interior wall of the duct 10 in a rotatable fashion. A shaft 42 extends outwardly through the duct from the frame 41, and a knob 43 is provided at an external end of this shaft. Thus, when this knob is rotated, the fan can be rotated. In addition, there is provided a means for positioning the fan in a first state in which air is caused to flow from the ceiling to the floor and a second state in which, by contrast, air is caused to flow from the floor to the ceiling. This comprises, for instance, a clicking means on frame 41 and duct 10, wherein projections are provided and holes into which the projections can be interlocked. When the fan is positioned in the first state, air near the ceiling, in other words, air in the upper portion of the room, is, as shown by an arrow comprising a solid line in FIG. 3, sucked into the duct through the first air port by means of the fan, and air so sucked is then caused to flow to a lower portion of the room, which is close to the floor through the second air port.

When the fan is positioned in the second state, as shown by an arrow comprising a dotted line also in FIG. 3, air near the floor, in other words, air in the lower portion of the room, is then sucked into the duct through the second air port by means of the fan, and air so sucked is caused to flow to the upper portion of the room, which is near the ceiling.

In short, in the above embodiment, it is possible to change the flow of air from the upper portion of the room to the lower portion thereof, or reversely from the lower portion of the room to the upper portion thereof, by fixing the duct relative to the wall surface and rotating the fan. Thus, with this configuration, although relatively warm air tends to gather in the upper portion of the room and relatively cool air remains in the lower portion of the room, if the flow of air is changed as described above, in other words, if warm air near the ceiling is caused to flow toward the floor and cool air near the floor caused to flow toward the ceiling, it is possible to minimize the difference in temperature of the room air, thereby creating a remarkably uniform room temperature.

Figure 4:
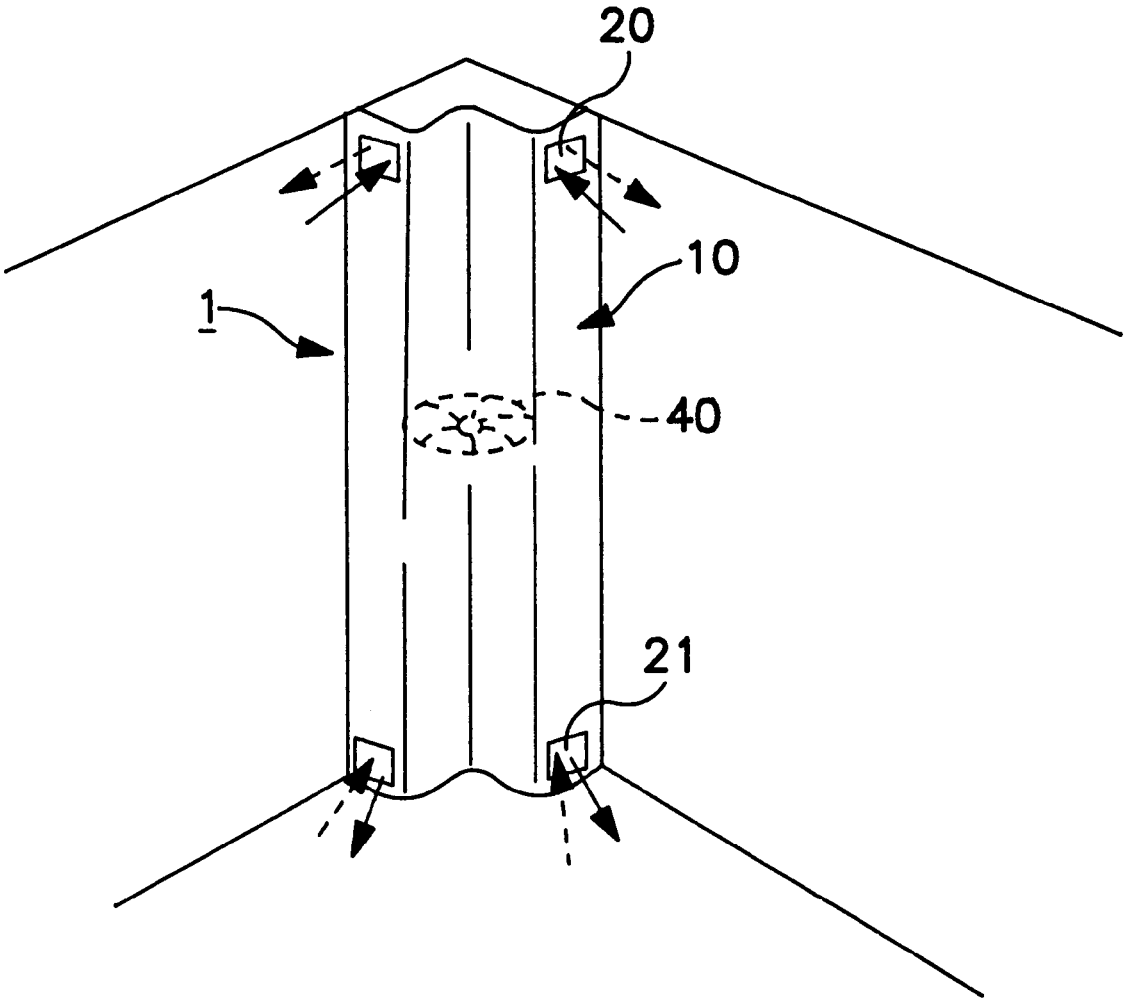
FIG. 4 is a perspective view showing an air circulating device of another embodiment of the present invention.

FIG. 4 shows an embodiment in which an air circulating device according to the present invention is disposed in a corner of a room.

In this embodiment also, a fan 40 is constructed in such a way that it can be reversed.

Figure 5:
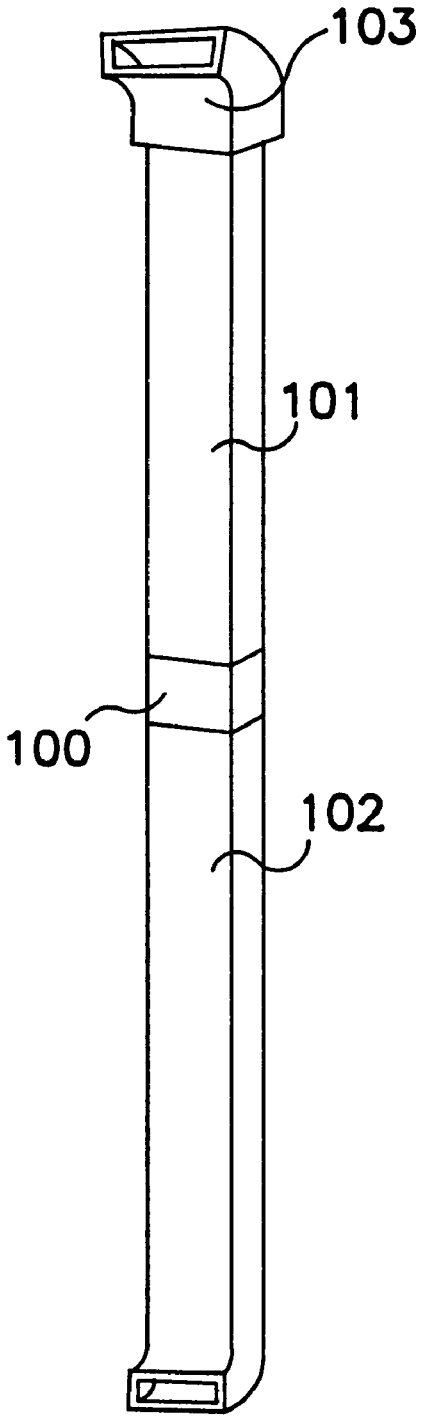
FIG. 5 is a perspective view of an air circulating device of a further embodiment of the present invention.

In an embodiment shown in FIG. 5, a duct 10 comprises a plurality of duct portions. In other words, this duct comprises a base 100, first and second duct portions 101, 102 both connected to the base, and an air port portion 103 connected to the first duct 101.

In this embodiment, an end of the duct portion 103 to which the air port portion 103 is connected can be cut so that the connecting end of the first duct portion 101 is cut on site to any length in accordance with the height of the ceiling. Afterwards the air port portion 103 is connected to a new connecting end of the first duct portion formed after such cutting.

With this configuration, the length of the duct can be altered in accordance with the height of a ceiling.

Figure 6:
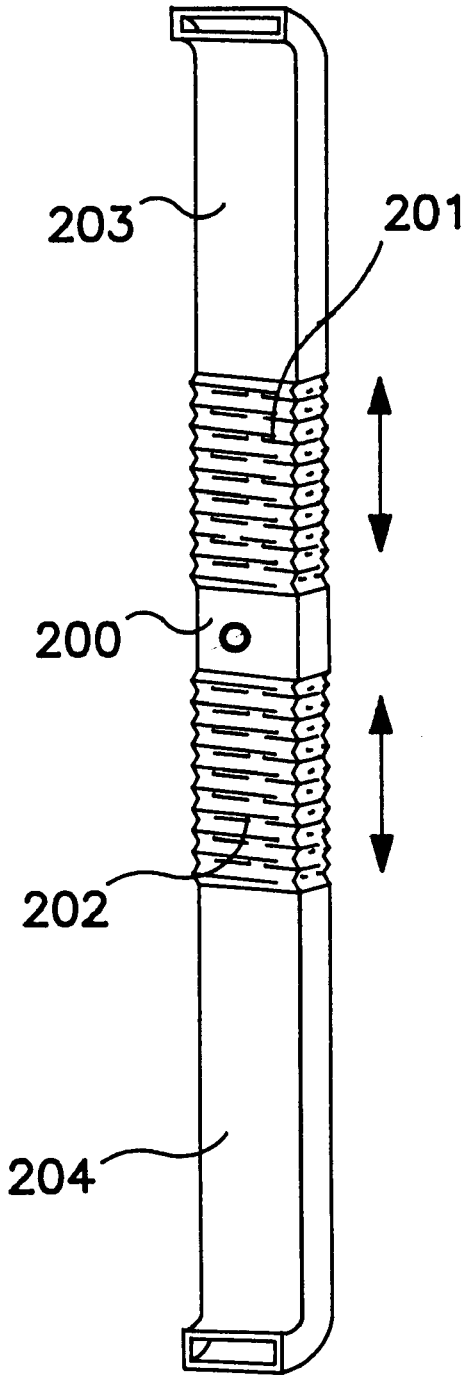
FIG. 6 is a perspective view of an air circulating device of a still further embodiment of the present invention.

FIG. 6 shows a duct comprising a base 200, and first and second duct portions 203, 204 connected thereto via bellows 201, 202 connected in turn to respective ends of the base. The length of a duct constructed as described above can be adjusted through the bellows 201 or 202.

Figure 7:
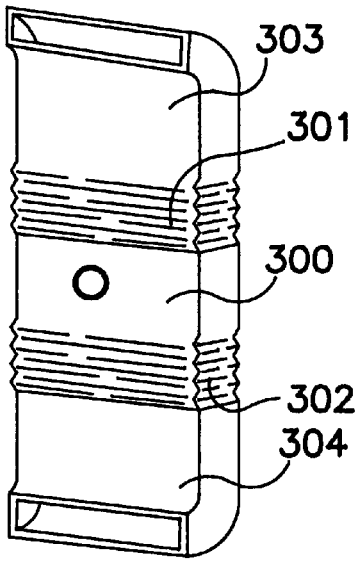
FIG. 7 is a perspective view of an air circulating device of another embodiment of the present invention.
Figure 8:
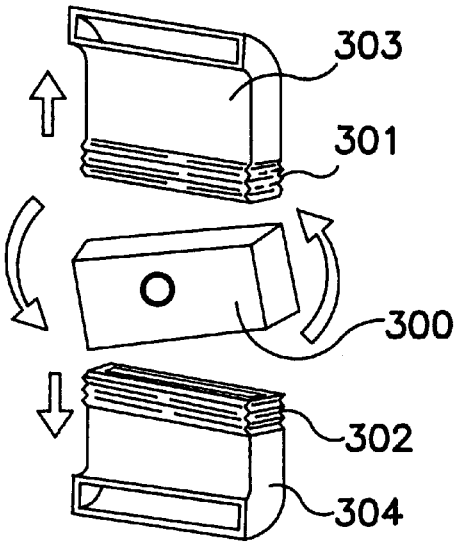
FIG. 8 is a perspective view of the air circulating device shown in FIG. 7 showing a state in which a fan is reversed.
Figure 9:
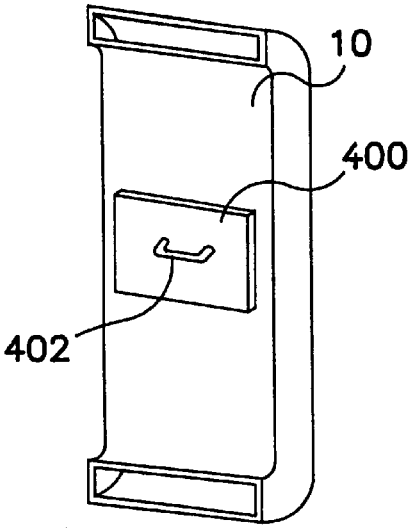
FIG. 9 is a perspective view of an air circulating device of a further embodiment of the present invention.
Figure 10:
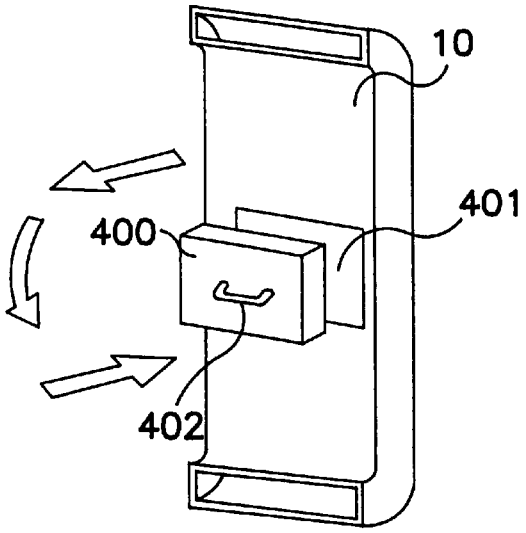
FIG. 10 is a perspective view of the air circulating device shown in FIG. 9 showing a state in which a fan is reversed.
Figure 11:
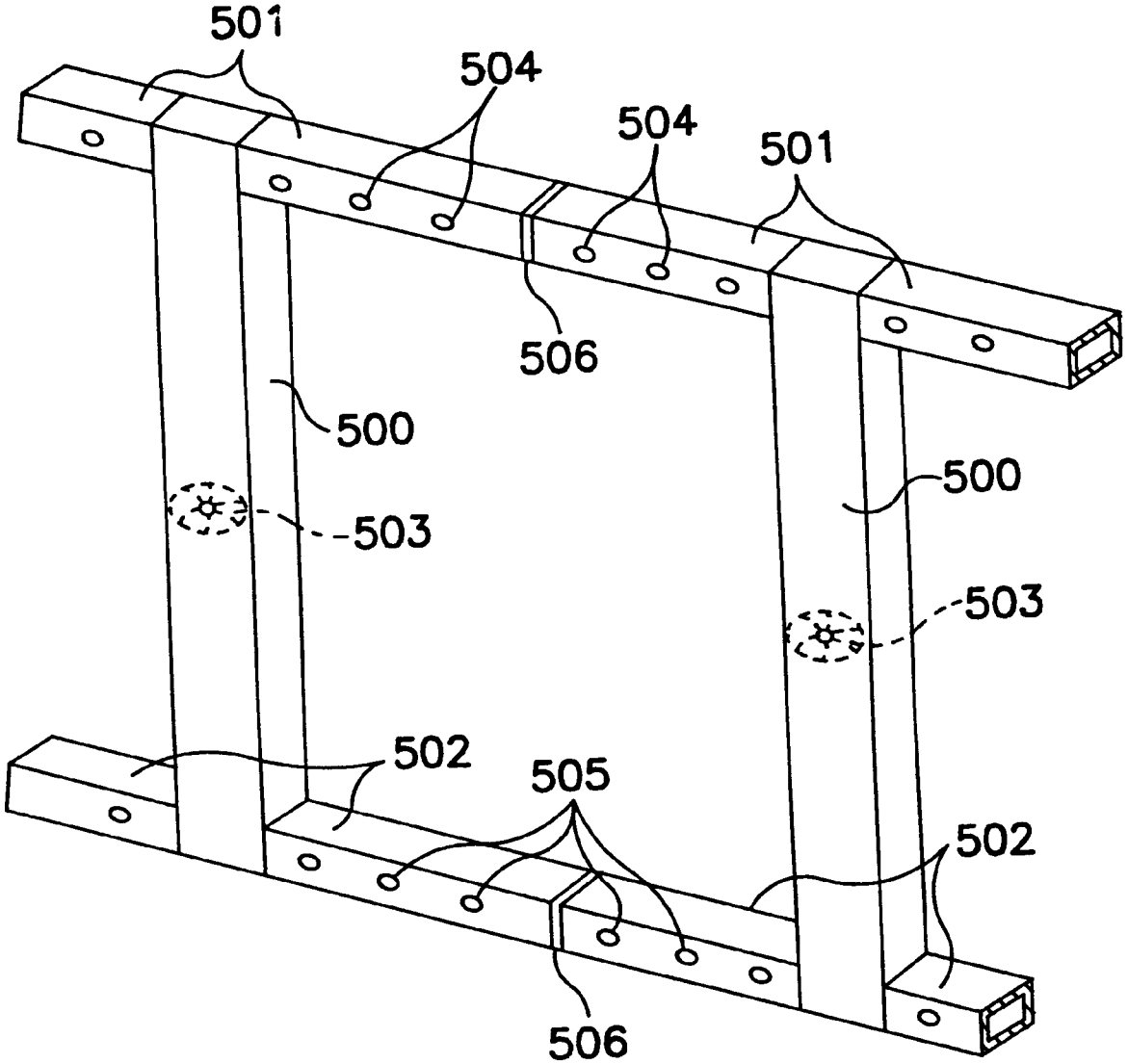
FIG. 11 is a perspective view of an air circulating device of a still further embodiment of the present invention.

FIGS. 7 and 8 show a duct comprising a base 300 rotatably mounted on the surface of a wall, bellows 301, 302 disposed at the upper and lower ends of the base and first and second duct portions 303, 304 connected to the bellows, respectively. A fan (not shown) is installed in the base. In this embodiment, the first and second duct portions are fixed to the wall surface and the bellows 301, 302 are in turn fixed to the first and second duct portions 301, 302, respectively, at one end thereof. The bellows 301, 302 are free relative to the wall surface, and the base 300 can be rotated as shown in FIG. 8. The bellows can be contracted in such a manner as not to affect the mounting of the first and second duct portions onto the wall surface.

In addition, it should be noted that in this embodiment, as shown in FIG. 7, the bellows 301, 302 are connected to the base in such a manner that when in use there is no escape of air from where they are connected to each other.

In this embodiment also, since the fan can be reversed by rotating the base, the flow of air can be changed such that air flows from the upper portion to the lower portion of a room and vice versa.

In this embodiment, a box 400 incorporating therein a fan (not shown) is configured as a box of a so-called drawer type. Namely, the box 400 can be smoothly inserted into an opening 401 formed in a duct 10. There is provided a handle 402 on the box.

In this embodiment, the box 400 is pulled out of the opening, then reversed, and inserted back into the opening, whereby the fan installed therein can also be reversed, so that the flow of air can be changed as described in the previous embodiment.

If the installation space is limited, only a single I-shaped duct may be used.

In this embodiment, each I-shaped duct comprises a vertical tube 500 mounted on the surface of a wall, an upper horizontal tube 501 disposed along a corner between the ceiling and the wall and a lower horizontal tube 502 disposed along a corner between the floor and the wall. A fan 503 is installed in the vertical tube 500 at a central portion thereof. A plurality of air ports are formed in the upper and lower horizontal tubes 501, 502 at certain longitudinal intervals.

In a case where there is enough installation space, another duct or a plurality of ducts configured as described above are connected thereto. In this case, the upper and lower horizontal tubes of the respective ducts are connected to each other via a suitable joint 506.

As is described above, in the air circulating devices of the present invention disclosed in the respective embodiments above, each has a fan installed therein, and the duct is mounted on the wall surface. The duct is reversed relative to the wall surface or the fan is reversed so that the flow of air is changed, whereby a difference in temperature between the upper portion and the lower portion of a room is eliminated. Thus, the air circulating device of the present is advantageous in that it is possible to maintain an even room temperature at all times.

I claim:

1. An air circulating device comprising:

at least one duct having a first air port at one end thereof, a second air port at an other end thereof, and an opening therein;

at least one air circulating fan provided in said at least one duct and mounted in said opening so as to be capable of being reversed with respect to said at least one duct so that air flow can be controlled to be suctioned from said first air port and flow to said second air port or suctioned from said second air port and flow to said first air port, said at least one air circulating fan being directly accessible and removably mounted so as to be capable of being pulled out of and inserted into said opening both when said at least one air circulating fan is reversed and when not reversed; and a mounting which fixes said at least one duct onto a wall surface.

2. An air circulating device comprising:

at least one duct having a first air port at one end thereof, a second air port at an other end thereof, and an opening therein;

at least one air circulating fan provided in said at least one duct and mounted in said opening so as to be capable of being reversed with respect to said at least one duct so that in one position of said at least one air circulating fan air flow can be controlled to be suctioned from said first air port and flow to said second air port and in a second position of said at least one air circulating fan air can be suctioned from said second air port and flow to said first air port, said at least one air circulating fan being directly accessible and removably mounted so as to be capable of being pulled out of and inserted into said opening both in said first position and in said second position; and a mounting which fixes said at least one duct onto a wall surface.

* * * * *